United States Patent [19]

Henriksen

[11] Patent Number: 5,016,286

[45] Date of Patent: May 21, 1991

[54] PROTECTIVE GLOVE

[76] Inventor: Henning R. Henriksen, Dronningensgade 25, DK-1420 Copenhagen K, Denmark

[21] Appl. No.: 478,051

[22] Filed: Feb. 2, 1990

Related U.S. Application Data

[63] Continuation of Ser. No. 391,654, Aug. 8, 1989, abandoned, which is a continuation of Ser. No. 124,014, Nov. 23, 1987, abandoned.

[30] Foreign Application Priority Data

May 29, 1987 [DE] Fed. Rep. of Germany ... 8707585[U]

[51] Int. Cl.[5] ..... A41D 19/00; A41D 19/02

[52] U.S. Cl. ..... 2/161 R; 2/163; 2/169

[58] Field of Search ..... 2/161, 163, 167, 169; 15/227

[56] References Cited

U.S. PATENT DOCUMENTS

| | | | |
|---|---|---|---|
| 2,880,436 | 4/1959 | Hayden | 15/227 X |
| 3,151,333 | 10/1964 | Scholz | 2/167 |
| 3,255,461 | 6/1966 | Bullock | 2/167 |
| 3,290,695 | 12/1966 | Burtoff | 2/161 R |
| 3,866,245 | 2/1975 | Sutherland | 2/169 |
| 3,867,727 | 2/1975 | Povlacs | 2/167 |
| 3,879,764 | 4/1975 | Weber-Liel | 2/167 |
| 4,034,853 | 7/1977 | Smith | 2/169 |
| 4,065,826 | 1/1978 | Hough | 2/167 |
| 4,084,265 | 4/1978 | Anfelt | 2/163 |
| 4,131,952 | 1/1979 | Brenning, Jr. | 2/161 R |
| 4,214,321 | 7/1980 | Nuwayser | 2/161 R |
| 4,240,157 | 12/1980 | Peters | 2/161 R |
| 4,371,988 | 2/1983 | Berend | 2/167 |
| 4,441,213 | 4/1984 | Trumble et al. | 2/163 |
| 4,510,640 | 4/1985 | Omori | 15/227 X |
| 4,643,791 | 2/1987 | Jurrivs et al. | 2/169 |
| 4,660,228 | 4/1987 | Ogawa et al. | 2/167 |
| 4,696,065 | 9/1987 | Elenteny | 2/164 |
| 4,745,635 | 5/1988 | Kinnear | 2/163 |
| 4,752,973 | 6/1988 | Wolfberg et al. | 2/163 |

FOREIGN PATENT DOCUMENTS

| | | | |
|---|---|---|---|
| 102992 | 11/1986 | European Pat. Off. . | |
| 1555846 | 12/1968 | France | 2/167 |

*Primary Examiner*—Werner H. Schroeder
*Assistant Examiner*—Jeanette E. Chapman
*Attorney, Agent, or Firm*—Merchant & Gould

[57] ABSTRACT

A protective glove which may be made from two superposed plastic films or film laminates comprises a palm portion, four finger portions, a thumb portion, and a wrist or sleeve portion. The width of at least one of the finger portions increases from a first value at a first position adjacent to the palm portion to a second maximum value at a second intermediate position where the joint of a finger received in the finger portion is located. Adjacent pairs of the finger portions are substantially mutually spaced, and the sleeve portion is preferably funnel-shaped. A concavely curved edge portion interconnecting the adjacent edge portions of the fourth finger portion and the sleeve portion, define an indentation.

7 Claims, 2 Drawing Sheets

PROTECTIVE GLOVE

Figure 1:
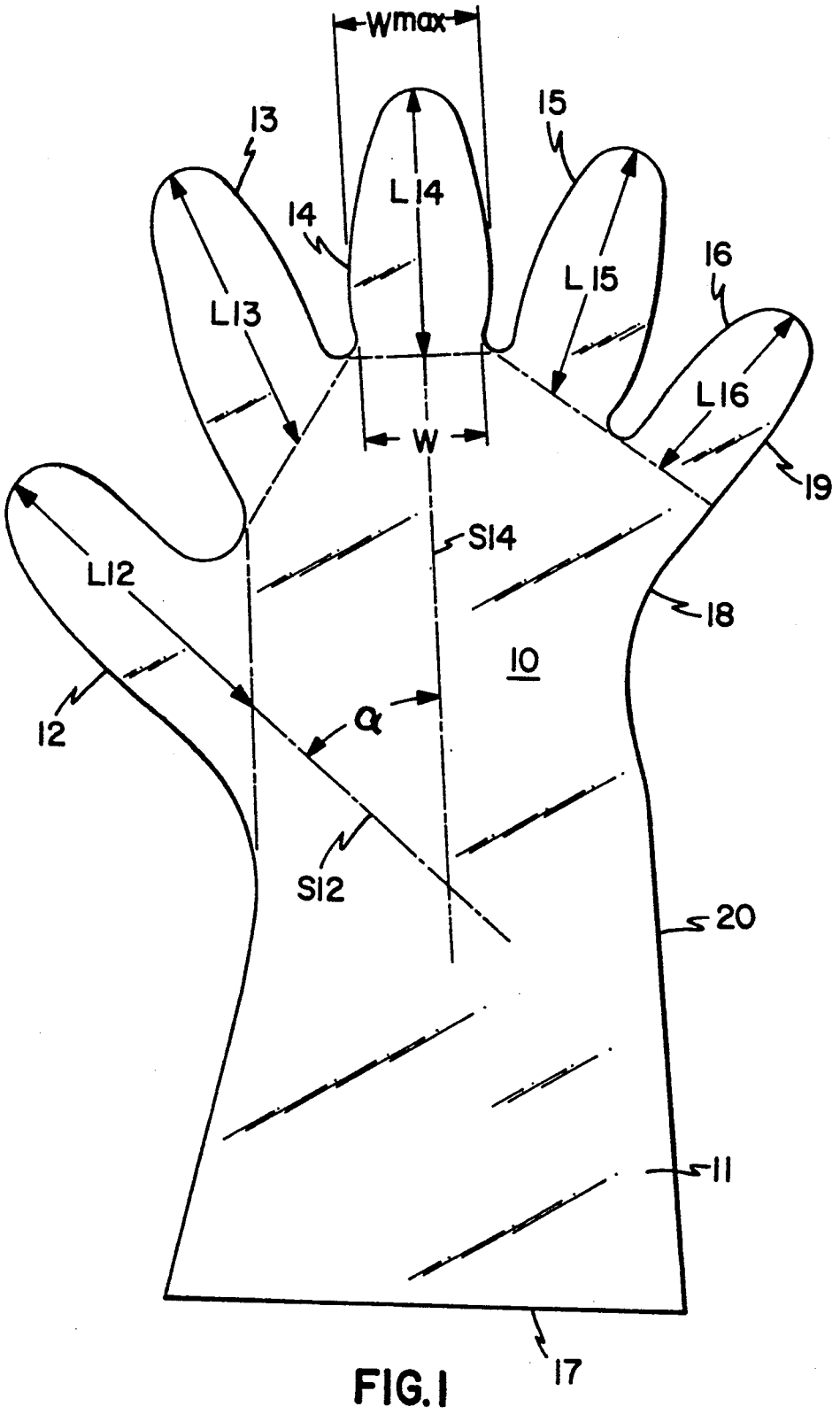

This is a continuation of application Ser. No. 07/391,654, filed Aug. 8, 1989, now abandoned, which is a continuation of application Ser. No. 07/124,014, filed Nov. 23, 1987, also now abandoned.

The present invention relates to a protective glove for protection against chemical compounds or mixtures thereof. Such glove may be made from flexible sheet material, such as plastic film, plastic laminate or elastomers, which is substantially impermeable to liquid and vapor. The glove may, for example, be of the type disclosed in the European Patent Specification No. 102,992. The fit of such conventional protective gloves is normally rather poor, and therefore they are less comfortable to wear.

Therefore, it is an object of the present invention to provide a glove of the above type having an improved fit and wearing comfort.

Thus, the present invention provides a protective glove comprising a palm portion, four finger portions, a thumb portion, and a wrist or sleeve portion for receiving the palm, the fingers, the thumb, and the wrist, respectively, of a human hand, in a flat condition of the glove the width of at least one of the finger portions increasing from a first value at a first position adjacent to the palm portion to a second, maximum value at a second position intermediate of said first portion and the free end of said finger portion. This is in contrast to the conventional protective gloves, wherein the finger portions have an outwardly tapered shape, and it has been found that the glove according to the invention is more comfortable to use because of the fact that the maximum width of one or more of the finger portions is at positions where the user's finger joints are received. Therefore, bending of the fingers does not tend to expel the fingers from the finger portions as is the case in conventional gloves with outwardly tapered finger portions.

The width may increase from said first value to said second, maximum value for any of the finger portions. In the preferred embodiment, however, it is true for at least each of the finger portions receiving the first, second, and third fingers, respectively, of the hand.

When the glove is of the disposable type it is important that it may be made relatively simply and cheaply. Thus, according to the invention the glove made be made from a pair of contoured, superposed walls, which are of flexible sheet material, and which are mutually sealed along their edges apart from an entrance opening defined at free end of the wrist or sleeve portion. When the glove is made from superposed walls of flexible sheet material, such as plastic film or laminated plastic films, it is important that the sealing seam along the edges of the contoured walls is sufficiently broad to obtain substantially the same low permeability through the seam material between the walls as transversely through each of the walls.

In order to further improve the fit and wearing comfort the sheet material of at least one of said superposed walls may be deep-drawable, or non-elasticly deformable, whereby the glove may adapt itself to the individual user, because a local stress induced in the walls of the glove during use, for example when the user bends his fingers, may cause a corresponding non elastic stretching of the wall material.

The adjacent edges of adjacent pairs of finger portions may substantially meet at the inner end or root of the finger portions adjacent to the palm portion as in the conventional glove of the present type. However, in the preferred embodiment of the glove according to the invention adjacent finger portions are mutually spaced at said first position at the inner end of the finger portions. It has been found that this further increases the wearing comfort of the glove. In order to avoid sharp corners which might promote tearing of the flexible sheet material, the edge portion of the glove interconnecting adjacent, mutually spaced finger portions may be concavely curved so as to substantially define a circular arc.

The wearing comfort of the glove according to the invention may be further improved by increasing the angle defined between the longitudinal axis of the thumb portion and the longitudinal axis of the finger portion for receiving the second finger of the hand. This angle may, e.g., be 40°-60°.

Furthermore, in the flat condition of the glove the width of the wrist or sleeve portion may decrease from a first value at the free end of the wrist or sleeve portion to a second minimum value adjacent to said palm portion. This feature further increases the fit and wearing comfort of the glove.

The flexible sheet material from which the glove is made may be any suitable, liquid and vapor impermeable sheet material which is sufficiently cheap for use in a disposable glove. In most cases, however, such flexible sheet material is a plastic film or a plastic film laminate, and the superposed plastic walls may then be mutually interconnected by heat sealing.

The invention will now be further described with reference to FIGS. 1 and 2 of the drawings, which show the contour of an embodiment of the glove according to the invention.

Figure 2:
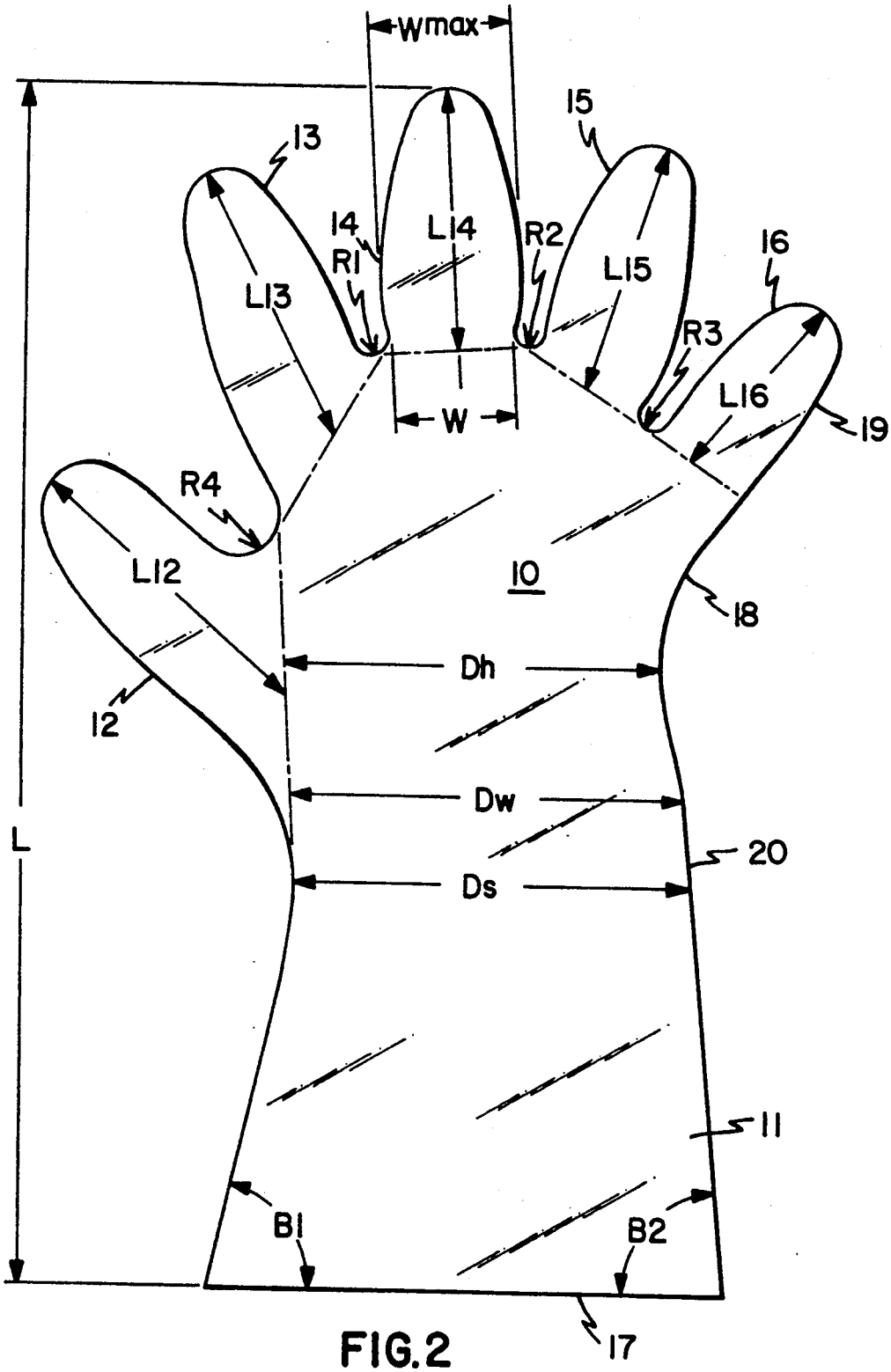

The glove shown in the drawings comprises a palm portion 10, a wrist or sleeve portion 11, a thumb portion 12, and finger portions 13, 14, 15, and 16 for the first, second, third, and fourth finger, respectively, vide FIG. 1.

The width of the finger portion 14 increases from a value W at the inner end of the finger portion to a maximum value $W_{max}$ at a position intermediate of this inner end and the free end of the finger portion 14. Any of the finger portions 13–16 and preferably all of the finger portions 13–15 may have a similar shape. The finger portions 13–16, which extend from the palm portion 10 in diverging relationship, are arranged with a substantial mutual spacing at the inner ends of the finger portions, and adjacent finger portions are interconnected by a concavely curved edge portion, which is preferably shaped as a circular arc with radii $R_1$, $R_2$ and $R_3$, respectively. Similarly, the thumb portion 12 and the finger portion 13 are interconnected by a concavely curved edge portion having a radius $R_4$.

The wrist or sleeve portion 11 is funnel-shaped so that it is tapered from its outer free end 17 to its inner end merging into the palm portion 10. A concavely curved edge portion 18 interconnecting the adjacent edge portions 19 and 20 of the fourth finger portion 16 and the sleeve portion 11, respectively, define an indentation opposite to the thumb portion as shown in the drawings. Such indentation provides an improved retainment of the glove on the hand of a user during use and reduces the amount of surplus uncomforting sheet material. The thumb portion 12 and the second finger portion 14 extend so as to define an angle $\alpha$ between the longitudinal axes S12 and S14 of these portions.

The glove shown in the drawings is made from two oppositely arranged flat plastic films which are interconnected by heat-sealing along the contour of the glove apart from the free end 17 of the free portion 11 so as to define an entrance opening.

EXAMPLE

The glove described above may, for example, be made in eight different sizes. As an example a size 10# termed "large" may have a total length of 444 mm (FIG. 2), the width W and the maximum width $W_{max}$ of the finger portion 14 may be 43 mm and 48 mm, respectively, the radii $R_1$, $R_2$, $R_3$, and $R_4$ may be 6.0 mm, 5.0 mm, 5.5 mm, and 14.0 mm, respectively. The maximum width of the sleeve portion 11 at its free end 17 may be 178 mm and the minimum sleeve width $D_s$, the widths $D_w$ and $D_h$ (FIG. 2) may be 135 mm, 134 mm, and 128 mm, respectively. The angle $\alpha$ may be about 49° and the angles $\beta 1$ and $\beta 2$ (FIG. 2) may be 76° and 85°, respectively. The lengths of the fingers L12, L13, L14, L15, and L16 (FIG. 2) may be 106 mm, 99 mm, 89 mm, 86 mm, and 68 mm, respectively.

The total lengths L (FIG. 2) of the various sizes as well as the scaling of all other proportions are stated in the following table. Thus, on the basis of the above dimensions of the size 10 corresponding dimensions of any of the other sizes may be calculated by using the scaling indicated in the following table. This means that any desired size may be obtained by proportional enlargement or reduction of the outline shown in the drawings.

TABLE

| Size Number | Length, L (mm) | Scaling in percent 10# as reference |
|---|---|---|
| 5# | 323 | 80.0 |
| 6# (Small) | 336 | 83.3 |
| 7# | 351 | 87.0 |
| 8# (Medium) | 368 | 91.1 |
| 9# | 386 | 95.5 |
| 10# (Large) | 404 | 100.0 |
| 11# | 423 | 104.8 |
| 12# (X-Large) | 444 | 110.0 |

The glove of the invention may preferably comprise a polymer material of the type described in European Patent Specification No. 102,992, which is incorporated by reference. A particularly preferred class of the polymer materials described in the above-identified European patent specification are copolymers of a $C_{2-5}$ alkene substituted with up to 4 hydroxy groups and a $C_{2-5}$ alkene, or homopolymers of a $C_{3-5}$ alkene substituted with up to 4 hydroxy groups. The $C_{2-5}$ alkene is preferably ethylene. An especially useful copolymer is a vinylalcohol-ethylene copolymer, preferably containing 40–80 mol % of vinyalcohol and 20–60 mol % of ethylene, in particular 65–75 mol % of vinylalcohol and 25–35 mol % of ethylene. Such materials may preferably be laminated between layers of other polymers, in particular polyethylene, e.g. as a polyethylene/vinylalcohol-ethylene-copolymer/polyethylene laminate.

What is claimed is:

1. A flat protective glove made from a pair of substantially planar superposed contoured flexible sheets of polymer material having mutually sealed edge portions, at least one of said sheets being non-elastically stretchable, said glove comprising:

a palm portion;

four finger portions for receiving the first, second, third and fourth finger, respectively, of a human hand, the finger portions extending from the palm portion, the width of at least one of the finger portions increasing from a first value at a first position adjacent to the palm portion to a second, maximum value at a second position intermediate of said first position and the free end of said finger portion;

a thumb portion extending from the palm portion in diverging relationship with the finger portions, the longitudinal axis of the thumb portion and the longitudinal axis of the finger portion for receiving the second finger of the hand defining the angle of 40°–60°; and a wrist or sleeve portion defining a hand entrance opening at its free end and having a width decreasing from a first value at the free end of the wrist or sleeve portion to a second minimum value adjacent to the palm portion, the palm portion having a concavely curved edge portion defining an indentation located opposite to the thumb portion between the fourth finger portion and the wrist portion so as to define a tortuous passage for the hand when inserted into the glove through the hand entrance opening, and wherein at least one edge portion interconnecting adjacent, mutually spaced finger portions is concavely curved so as to substantially define a circular arc of predetermined radius where the radii of the circular edge portions between the first and second finger, the second and third finger, and the third and fourth finger are 6 mm, 5 mm, and 5.5 mm, respectively, and wherein the radius of the circular arc-shaped edge portion between the thumb portion and the first finger portion is 14 mm.

2. A glove according to claim 1 wherein a joint of a finger received in any of said finger portions is located at or adjacent to said second intermediate position.

3. A glove according to claim 1, wherein said flexible sheet material is a plastic film laminate.

4. A glove according to claim 3, wherein said superposed walls are interconnected by heat-sealing.

5. A glove according to claim 1, wherein the width of the finger portion increases from said first value to said second, maximum value for each of the finger portions receiving the first, second, and third fingers, respectively, of the hand.

6. A glove according to claim 1, wherein said sheets of polymer comprise a polymer film laminate.

7. A glove according to claim 1, wherein said superposed sheets of polymer material are interconnected by heat-sealing.

* * * * *